United States Patent [19]

Ogawa et al.

[11] Patent Number: 4,762,775

[45] Date of Patent: Aug. 9, 1988

[54] SILVER HALIDE PHOTOGRAPHIC MATERIAL

[75] Inventors: Tadashi Ogawa; Takeshi Hirose, both of Kanagawa, Japan

[73] Assignee: Fuji Photo Film Co., Ltd., Kangawa, Japan

[21] Appl. No.: 889,526

[22] Filed: Jul. 25, 1986

[30] Foreign Application Priority Data

Jul. 25, 1986 [JP] Japan ..... 60-162874

[51] Int. Cl.[4] ..... G03C 1/46

[52] U.S. Cl. ..... 430/505; 430/558; 430/642; 430/935

[58] Field of Search ..... 430/505, 558, 642, 935, 430/545, 546

[56] References Cited

U.S. PATENT DOCUMENTS 4,559,297 12/1985 Seto et al. ..... 430/551

4,585,732 4/1986 Kawagishi et al. ..... 430/558

FOREIGN PATENT DOCUMENTS 736431 6/1966 Canada ..... 430/546

*Primary Examiner*—Paul R. Michl

*Assistant Examiner*—Patrick A. Doody

*Attorney, Agent, or Firm*—Sughrue, Mion, Zinn, Macpeak & Seas

[57] ABSTRACT

A silver halide photographic material is disclosed, comprising a support having provided thereon at least one light-sensitive silver halide emulsion layer, wherein said emulsion layer or a layer adjacent thereto contains at least one pyrazoloazole coupler and substantially all photographic layers including the light-sensitive silver halide layer and the layer adjacent thereto each having been coated on the same surface of the support and then dried have a pH lower than a pKa of said coupler by 1.0 or more. The material exhibits improved color reproducibility, sensitivity and development stability.

9 Claims, No Drawings

SILVER HALIDE PHOTOGRAPHIC MATERIAL

FIELD OF THE INVENTION

This invention relates to a silver halide photographic material having improved color reproducibility, sensitivity and development stability.

BACKGROUND OF THE INVENTION

It is well known that an aromatic primary amine color developing agent is oxidized with an exposed silver halide as an oxidizing agent and the thus oxidized developing agent is reacted with a coupler to form an indophenol dye, an indoaniline dye, an indamine dye, an azomethine dye, a phenoxazine dye, a phenazine dye or an analogue thereof to thereby obtain a color image.

Most of the conventional magenta color image forming couplers which have widely been put to practical use and also intensively studied are 5-pyrazolone couplers. The 5-pyrazolone couplers are excellent in color formation rate and efficiency and azomethine dyes formed therefrom exhibit excellent fastness to light and heat. It is known, however, that these couplers show unfavorable absorption of yellow components in the vicinity of 430 nm, that should cause poor color reproduction.

Magenta color image forming skeletons so far proposed to reduce the yellow components include a pyrazolobenzimidazole skeleton as described in British Pat. No. 1,047,612; a pyrazolotriazole skeleton as described in U.S. Pat. No. 3,725,067; a pyrazoloimidazole skeleton as described in U.S. Pat. No. 4,500,630; a pyrazolopyrazole skeleton as described in Japanese Patent Application (OPI) No. 43659/85 (the term "OPI" as used herein refers to a "published unexamined Japanese patent application"); and a pyrazolotriazole skeleton as described in European Pat. No. 119,860A.

Any of the dyes formed by these couplers is superior to those formed by the conventional 5-pyrazolone couplers in terms of freedom from unnecessary absorption of yellow components. Further, these proposed couplers are advantageous for color reproduction in that the absorption in the longer wavelength side of an absorption spectrum sharply becomes zero.

The present inventors have found, however, that these pyrazoloazole couplers also possess unfavorable properties as set forth below in spite of their superiority.

When these couplers coexist with silver halides that are necessary as oxidizing agents for an aromatic primary amine developing agent to cause a color reaction, more specifically, when an emulsion of these couplers and a silver halide emulsion are mixed to prepare a coating composition, examination of the photographic properties revealed that the sensitivity, gradation and fog inherent in the silver halide emulsion used are not manifested, and the silver halide emulsion, in some cases, undergoes sensitization or densitization or suffers from reduction in color density. This behavior of the silver halide emulsion can be confirmed by making a comparison with the results obtained by color development or black-and-white development of a photographic material using 5-pyrazolone couplers under the same conditions. A part of the behavior can also be proved by comparing the results obtained by black-and-white development of a photographic material containing the silver halide emulsion alone without using any coupler.

Couplers to be used in silver halide color photographic materials are not essentially expected to exert any influence on silver halide emulsions except for development inhibitor-releasing couplers or development accelerator-releasing couplers. In particular, it is not favorable that the couplers have any influence upon the light-sensitive mechanism to induce sensitization or desensitization.

The above-described influences on silver halides are scarcely noted in the 5-pyrazolone couplers having been broadly employed as magenta color image-forming couplers, but are widely observed among the pyrazoloazole couplers. Therefore, in order to fully and practically utilize excellent hues developed by the pyrazoloazole couplers, it is highly beneficial to exclude all the aforesaid influences on silver halides.

SUMMARY OF THE INVENTION

An object of this invention is to provide a silver halide photographic material excellent in color reproducibility, sensitivity and image density.

Another object of this invention is to provide a silver halide photographic material containing at least one pyrazoloazole coupler, which has stable photographic sensitivity and provides a sufficient image density.

A further object of this invention is to provide a process for producing a silver halide photographic material excellent in color reproducibility, photographic sensitivity and image density.

A still further object of this invention is to provide a process for stably producing a silver halide photographic material containing at least one pyrazoloazole coupler.

The above objects of the present invention can be accomplished by providing a silver halide photographic material comprising a support having provided thereon at least one light-sensitive silver halide emulsion layer, wherein the emulsion layer or a layer adjacent thereto contains at least one pyrazoloazole coupler and substantially all the photographic layers including the light-sensitive silver halide layer and the layer adjacent thereto each having been coated on the same surface of the support and then dried has a pH lower than a pKa value of the coupler by 1.0 or more.

DETAILED DESCRIPTION OF THE INVENTION

The pyrazoloazole couplers which can be used in the present invention are represented by the formula (I):

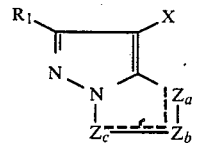

(I)

wherein $R_1$ represents a hydrogen atom or a substituent; X represents a hydrogen atom or a group releasable upon coupling with an oxidation product of an aromatic primary amine developing agent; $Z_a$, $Z_b$ and $Z_c$ each represents a methine group, a substituted methine group, =N— or —NH—; either one of the $Z_a$-$Z_b$ bond and the $Z_b$-$Z_c$ bond is a double bond with the other being a single bond; when the $Z_b$-$Z_c$ bond is a carbon-carbon double bond, it may form an aromatic ring; when any one of $R_1$, X and the substituted methine group as represented by $Z_a$, $Z_b$ or $Z_c$ is a divalent or polyvalent group, it may form a dimer or polymer.

The compounds represented by the formula (I) are 5-membered ring condensed nitrogen-containing heterocyclic couplers, whose color forming nuclei exhibit aromaticity isoelectrical to a naphthalene nucleus and have chemical structures usually called azapentalenes, inclusively.

Among the couplers represented by the formula (I), the preferred compounds are 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles represented by the formulae (I-1), (I-2), (I-3), (I-4), (I-5) and (I-6), respectively:

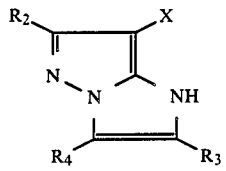
(I-1)

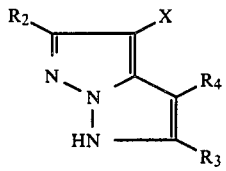
(I-2)

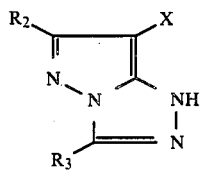
(I-3)

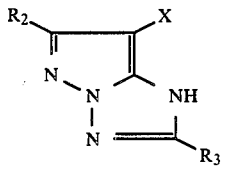
(I-4)

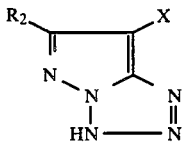
(I-5)

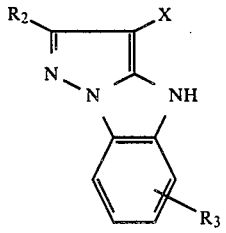
(I-6)

wherein $R_2$, $R_3$ and $R_4$ each represents a hydrogen atom, a substituted or unsubstituted alkyl group (e.g., a methyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), a substituted or unsubstituted aryl group (e.g., a phenyl group, a 4-t-butylphenyl group, a 2,4-di-t-amylphenyl group, a 4-tetradecanamidophenyl group, etc.), a substituted or unsubstituted heterocyclic group (e.g., a 2-furyl group, a 2-thienyl group, a 2-pyrimidinyl group, a 2-benzothiazolyl group, etc.), a cyano group, a substituted or unsubstituted alkoxy group (e.g., a methoxy group, an ethoxy group, a 2-methoxyethoxy group, a 2-dodecyloxyethoxy group, a 2-methanesulfonylethoxy group, etc.), a substituted or unsubstituted aryloxy group (e.g., a phenoxy group, a 2-methylphenoxy group, a 4-t-butylphenoxy group, etc.), a substituted or unsubstituted heterocyclic oxy group (e.g., a 2-benzimidazolyloxy group, etc.), a substituted or unsubstituted acyloxy group (e.g., an acetoxy group, a hexadecanoyloxy group, etc.), a substituted or unsubstituted carbamoyloxy group (e.g., an N-phenylcarbamoyloxy group, an N-ethylcarbamoyloxy group, etc.), a substituted or unsubstituted silyloxy group (e.g., a trimethylsilyloxy group, etc.), a substituted or unsubstituted sulfonyloxy group (e.g., a dodecylsulfonyloxy group, etc.), a substituted or unsubstituted acylamino group (e.g., an acetamido group, a benzamido group, a tetradecanamido group, an α-(2,4-di-t-amylphenoxy)-butyramido group, an α-(3-t-butyl-4-hydroxyphenoxy)-butyramido group, an α-[4-(4-hydroxyphenylsulfonyl)-phenoxy]decanamido group, etc.), a substituted or unsubstituted anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), a substituted or unsubstituted ureido group (e.g., a phenylureido group, a methylureido group, an N,N-dibutylureido group, etc.), a substituted or unsubstituted imido group (e.g., an N-succinimido group, a 3-benzylhydantoinyl group, a 4-(2-ethylhexanoylamino)phthalimido group, etc.), a substituted or unsubstituted sulfamoylamino group (e.g., an N,N-dipropylsulfamoylamino group, an N-methyl-N-decylsulfamoylamino group, etc.), a substituted or unsubstituted carbamoylamino group (e.g., an N-butylcarbamoylamino group, an N,N-dimethylcarbamoylamino group, etc.), a substituted or unsubstituted alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), a substituted or unsubstituted arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a substituted or unsubstituted heterocyclic thio group (e.g., a 2-benzothiazolyl group, etc.), a substituted or unsubstituted alkoxycarbonylamino group (e.g., a methoxycarbonylamino group, a tetradecyloxy carbonylamino group, etc.), a substituted or unsubstituted aryloxycarbonylamino group (e.g., a phenoxycarbonylamino group, a 2,4-di-tert-butylphenoxycarbonylamino group, etc.), a substituted or unsubstituted sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a substituted or unsubstituted carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tertamylphenoxy)propyl]carbamoyl group, etc.), a substituted or unsubstituted acyl group (e.g., an acetyl group, a (2,4-di-tert-amylphenoxy)acetyl group, a benzoyl group, etc.), a substituted or unsubstituted sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a substituted or unsubstituted sulfonyl group (e.g., a methanesulfonyl group, an octanesulfonyl group, a benzenesulfonyl group, a toluenesulfonyl group, etc.), a substituted or unsubstituted sulfinyl group (e.g., an octanesulfinyl group, a dodecylsulfinyl group, a phenylsulfinyl group, etc.), a substituted or unsubstituted alkoxycarbonyl group (e.g., a methoxycarbonyl group, a butyloxycarbonyl group, a dodecylcarbonyl group, an octadecylcarbonyl group, etc.), a substituted or unsubstituted aryloxycarbonyl group (e.g., a phenyloxycarbonyl group, a 3-pentadecyloxycarbonyl group, etc.), a substituted or unsubstituted alkenyl group, a substituted or unsubstituted carboxyl group, a substituted or unsubstituted sulfo group, a hydroxyl group, a substituted or unsubstituted amino group, or a substituted or unsubstituted carbonamido group. The substituents for these groups include a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfonylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, a hydroxyl group, an amino group, and a carbonamido group, etc. $R_2$, $R_3$ and $R_4$ each preferably represents an alkyl group, an aryl group, a carbonamido group, a sulfonamido group or a ureido group.

When the formula (I-6) contains two or more $R_3$ substituents, they may be the same or different.

X represents a hydrogen atom or a group releasable upon coupling with an oxidation product of an aromatic primary amine developing agent (hereinafter referred to as "coupling off group"). When X represents a coupling off group, such a coupling off group includes a group containing an aliphatic group, an aromatic group, a heterocyclic group, an aliphatic, aromatic or heterocyclic sulfonyl group or an aliphatic, aromatic or heterocyclic carbonyl group which is bonded to the coupling active carbon via an oxygen atom, a nitrogen atom, a sulfur atom or a carbon atom, a halogen atom, an aromatic azo group, and the like. The aliphatic, aromatic or heterocyclic group contained in these coupling off groups may have one or more substituents selected from those enumerated for $R_2$, $R_3$ or $R_4$, which may be the same or different.

Specific examples of the coupling off groups include a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methanesulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), an aliphatic or aromatic sulfonyloxy group (e.g., a methanesulfonyloxy group, a toluenesulfonyloxy group, etc.), an acylamino group (e.g., a dichloroacetylamino group, a trifluoroacetylamino group, a heptafluorobutyrylamino group, etc.), an aliphatic or aromatic sulfonamido group (e.g., a methanesulfonamido group, a p-toluenesulfonamide group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic, aromatic or heterocyclic thio group (e.g., an ethylthio group, a phenylthio group, etc.), a carbamoylamino group (e.g., an N-methylcarbamoylamino group, an N-phenylcarbamoylamino group, etc.), a 5-membered or 6-membered nitrogen-containing heterocyclic group (e.g., an imidazolyl group, a pyrazolyl group, a triazolyl group, a tetrazolyl group, a 1,2-dihydro-2-oxo-1-pyridyl group, etc.), an imido group (e.g., a succinimido group, a hydantoinyl group, etc.), an aromatic azo group (e.g., a phenylazo group, etc.), and the like. Some of these groups may have substituents selected from those enumerated for $R_2$, $R_3$ and $R_4$.

The preferred among the above-described coupling off groups are a halogen atom, an alkoxy group, an aryloxy group, a sulfonyloxy group and an acylamino group.

Coupling off groups bonded to the coupling position via a carbon atom include an aldehyde or a ketone, at which two molecules of a 4-equivalent coupler are condensed to form a bis form coupler.

In the above formulae (I-1) to (I-6), any one of $R_2$, $R_3$, $R_4$ and X may be a divalent or polyvalent group, at which to form a dimer or a polymer or to be bonded to a high molecular main chain to form a high molecular coupler.

Among the above-described pyrazoloazole couplers of the formulae (I-1) to (I-6), the particularly preferred are the compounds of the formulae (I-1) and (I-4).

Examples of the pyrazoloazole couplers of the formula (I-1) to (I-6) and processes for synthesis thereof are described, e.g., in the following publications: The compounds of the formula (I-1) are described in Japanese Patent Application (OPI) No. 162548/84 (corresponding to U.S. Pat. No. 4,500,630), etc.; the compounds of the formula (I-2) are described in Japanese Patent Application (OPI) No. 43659/85, etc.; the compounds of the formula (I-3) are described in Japanese Patent Publication No. 27411/72, etc.; the compounds of the formula (I-4) are described in Japanese Patent Application (OPI) Nos. 171956/84 and 172982/85, etc.; the compounds of the formula (I-5) are described in Japanese Patent Application (OPI) No. 33552/85, etc.; and the compounds of the formula (I-6) are described in U.S. Pat. No. 3,061,432, etc.

In addition, the highly color developable ballast groups disclosed in Japanese Patent Application (OPI) Nos. 42045/83, 214854/84, 177553/84, 177554/84 and 177557/84, etc., can be applied to any of the compounds of the formulae (I-1) to (I-6).

Specific but non-limiting examples of the pyrazoloazole couplers which can be used in the present invention are shown below:

(M-1)
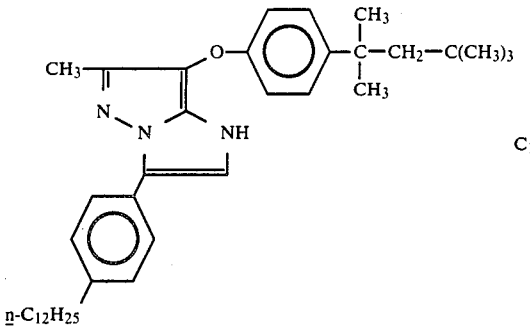
(M-2)
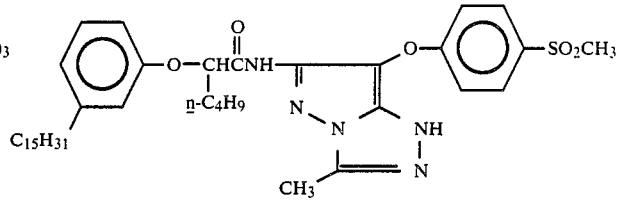
(M-3)
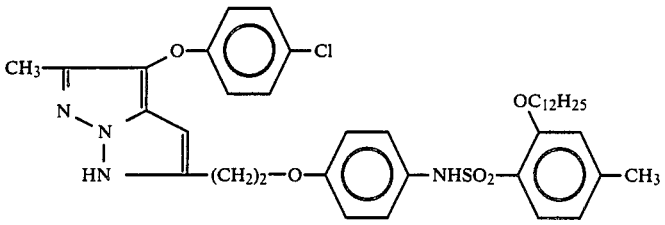
(M-4)
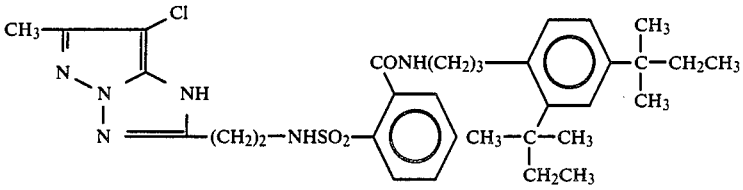
(M-5)
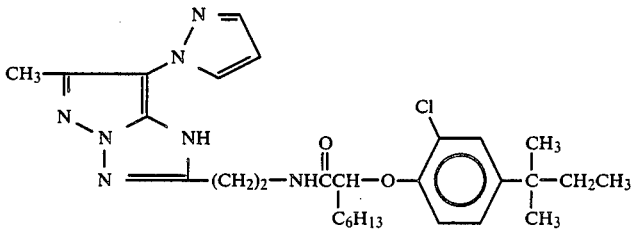
(M-6)
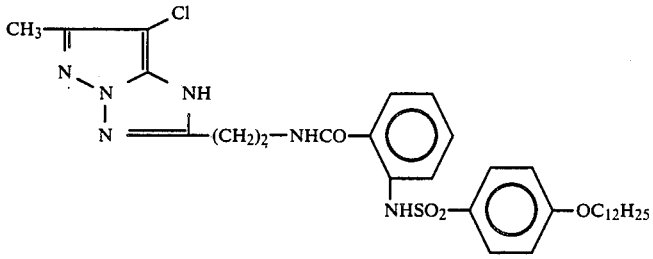
(M-7)
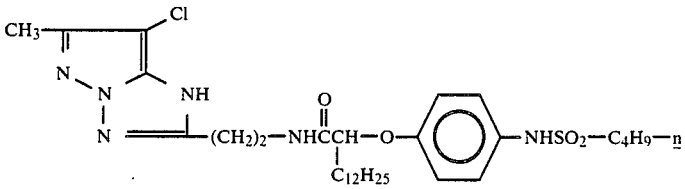

-continued
(M-8)
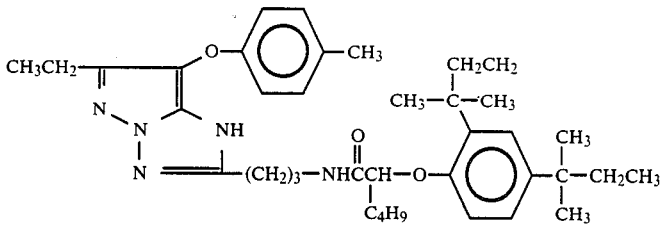
(M-9)
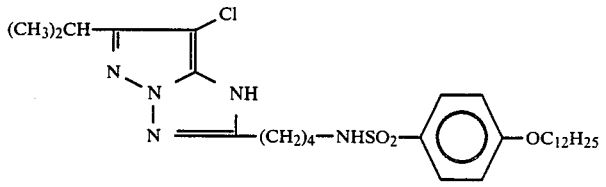
(M-10)
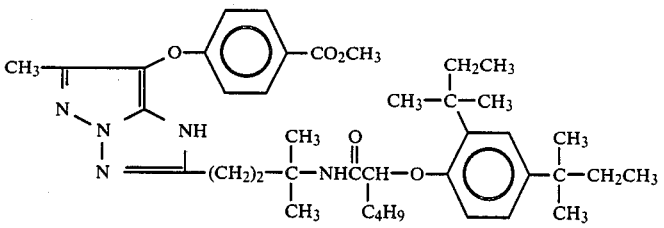
(M-11)
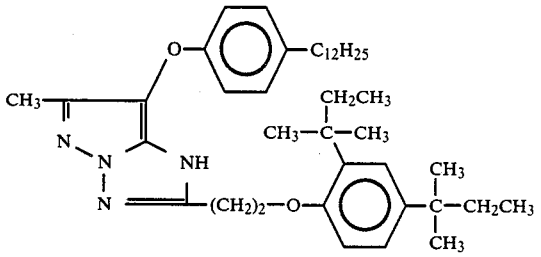
(M-12)
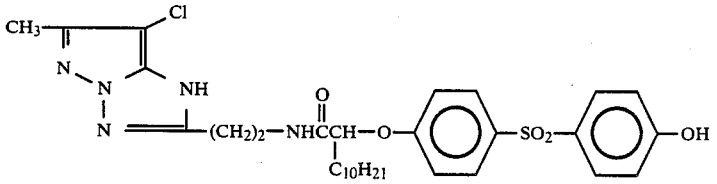
(M-13)
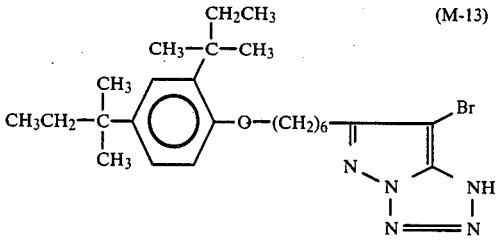
(M-14)
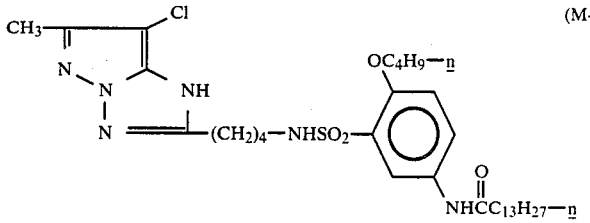
(M-15)
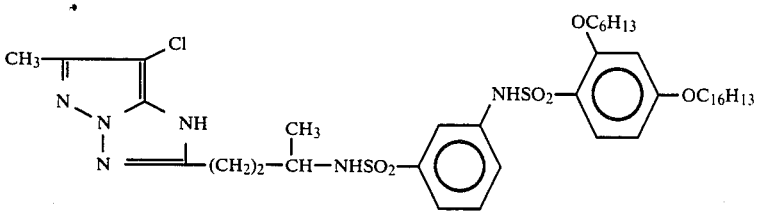

-continued
(M-16)
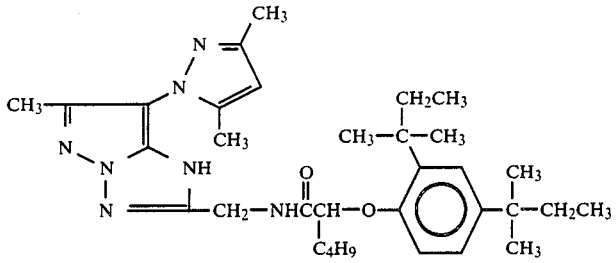
(M-17)
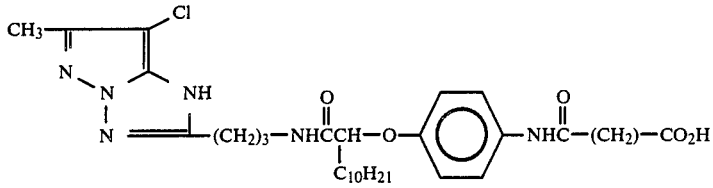
(M-18)
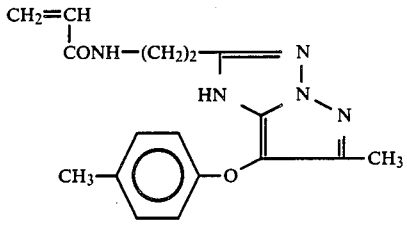
(M-19)
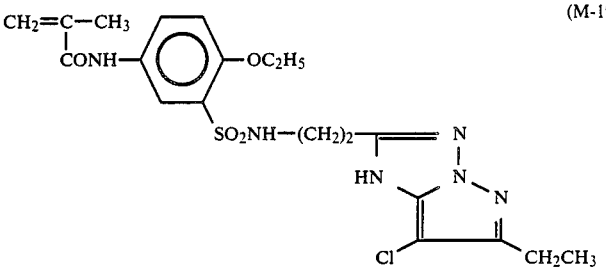
(M-20)
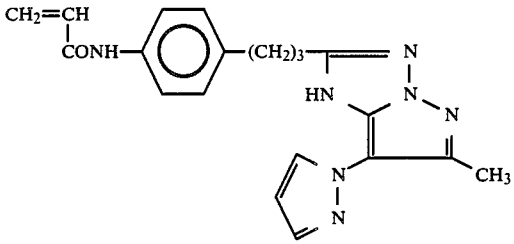
(M-21)
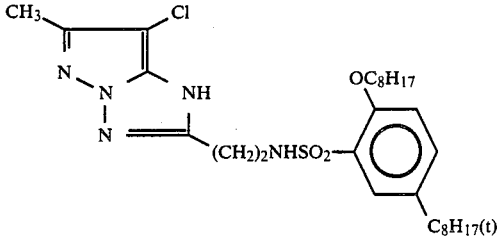
(M-22)
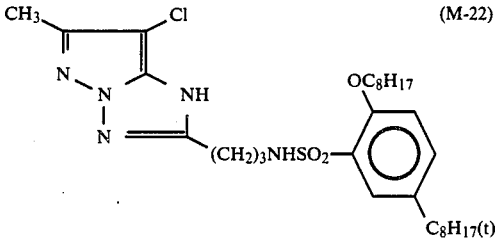
(M-23)
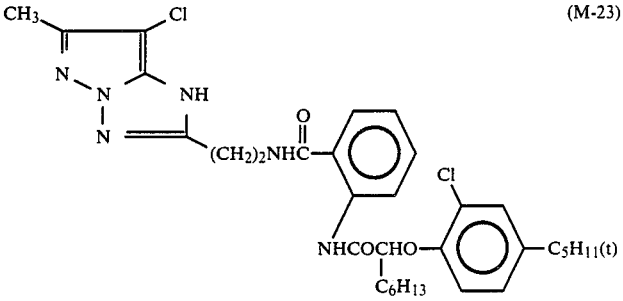
(M-24)
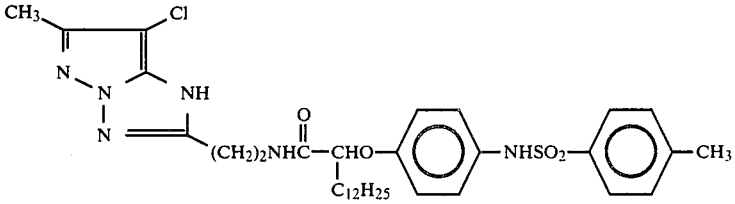

-continued
(M-25)
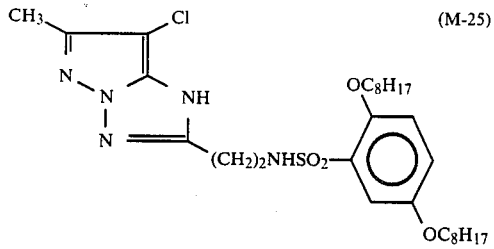
(M-26)
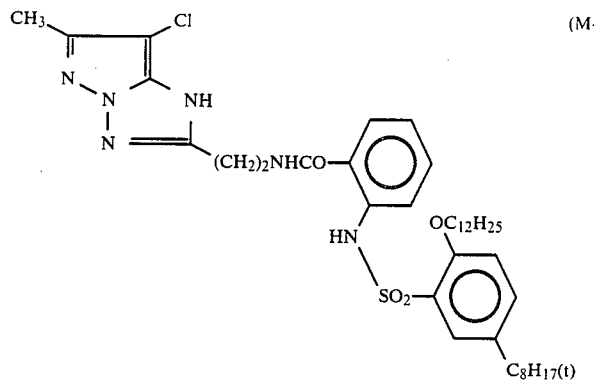
(M-27)
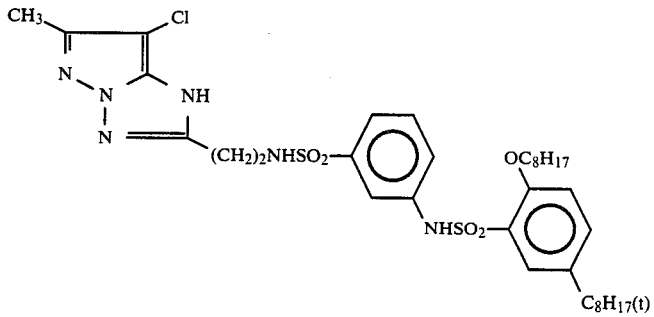
(M-28)
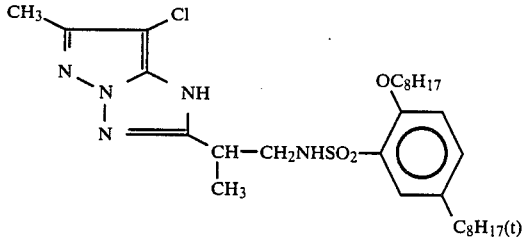
(M-29)
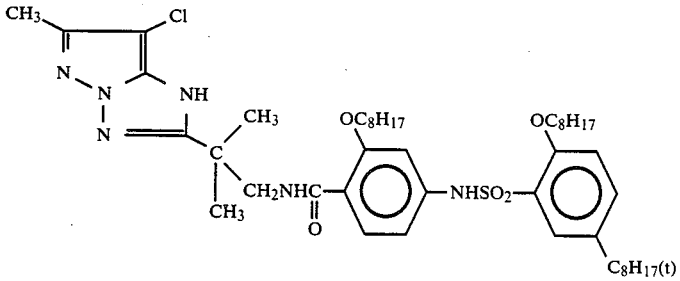
(M-30)
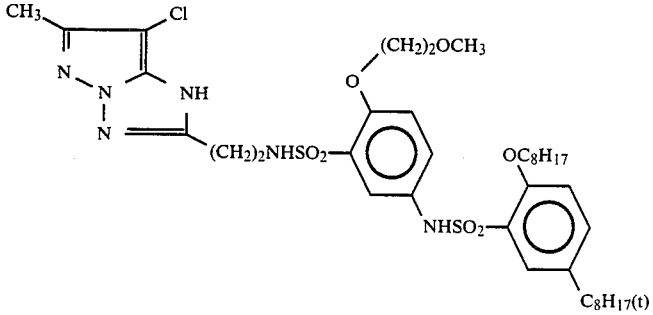

-continued
(M-31)
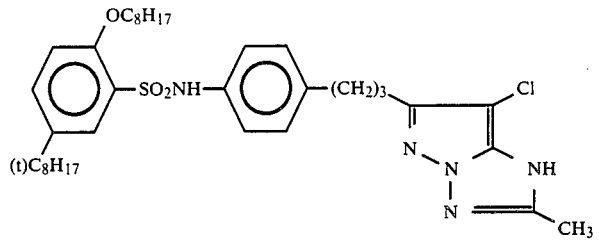
(M-32)
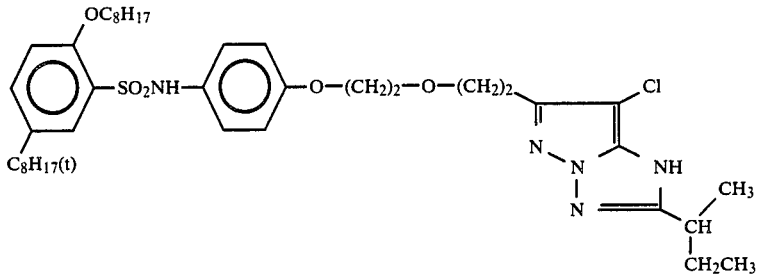
(M-33)
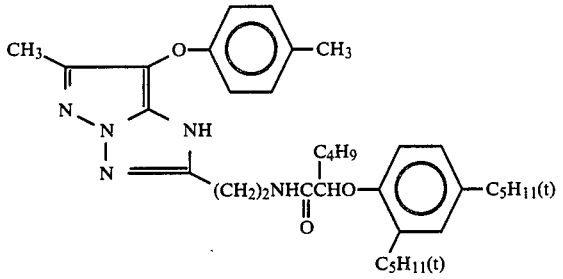
(M-34)
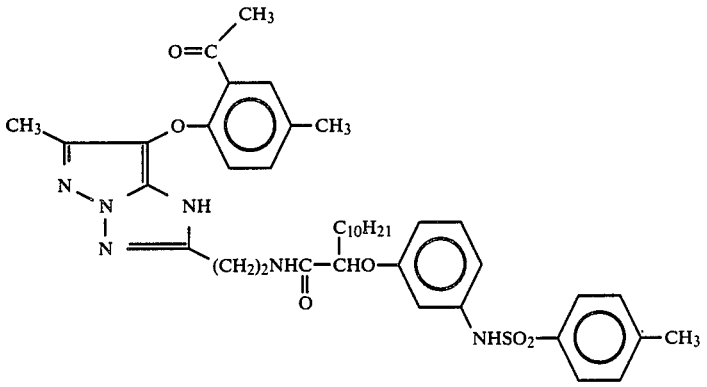
(M-35)
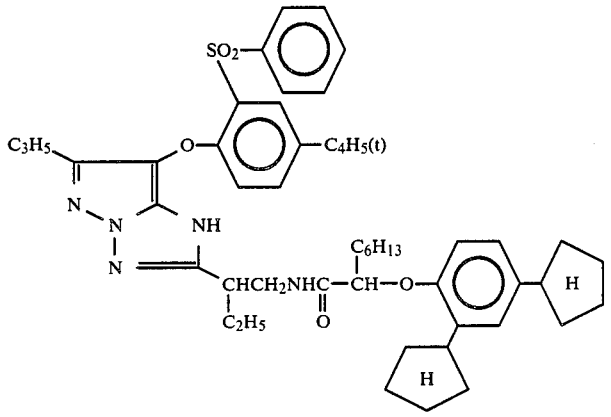

-continued
(M-36)
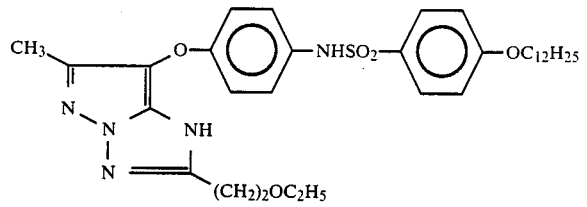
(M-37)
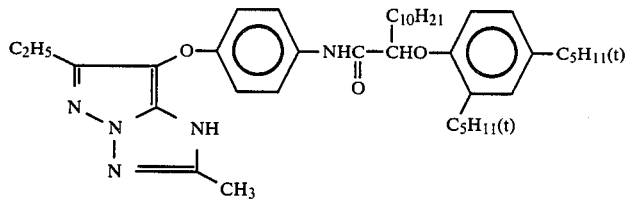
(M-38)
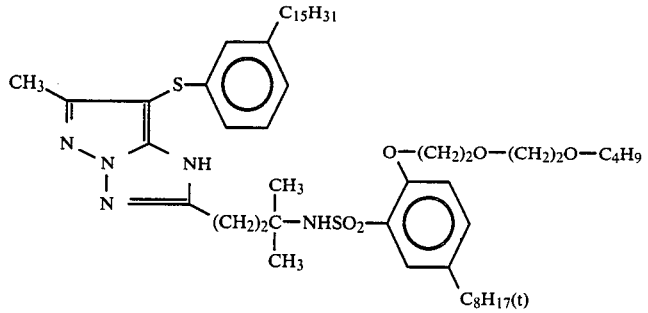
(M-39)
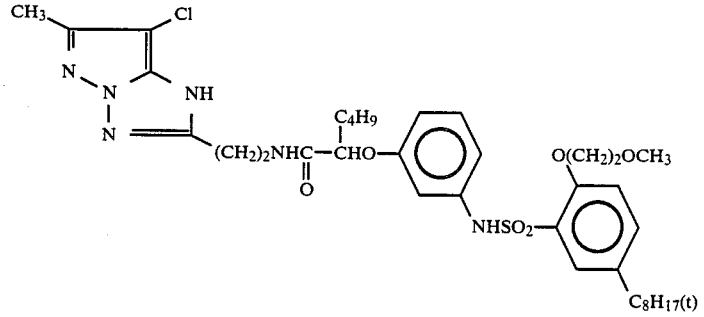
(M-40)
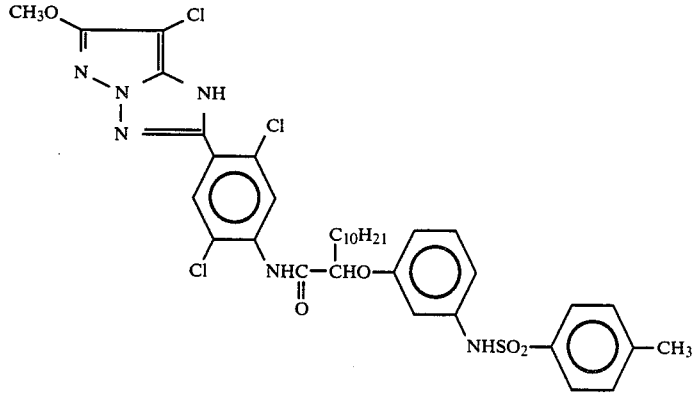
(M-41)
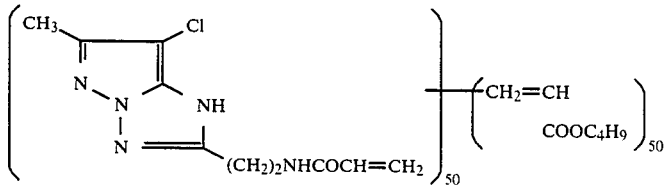

-continued
(M-42)
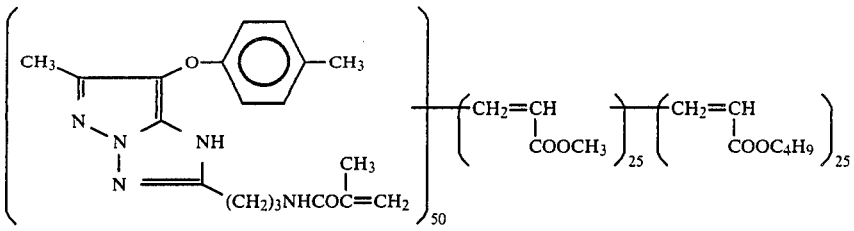
(M-43)
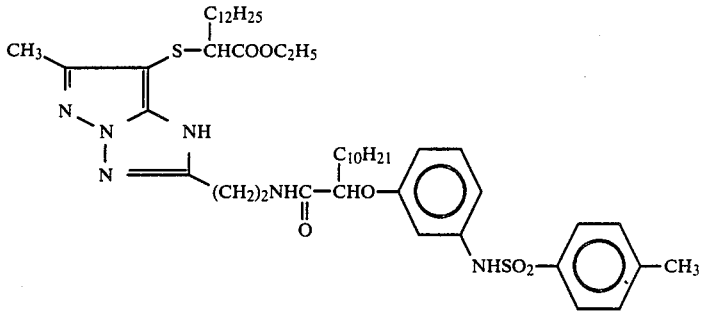
(M-44)
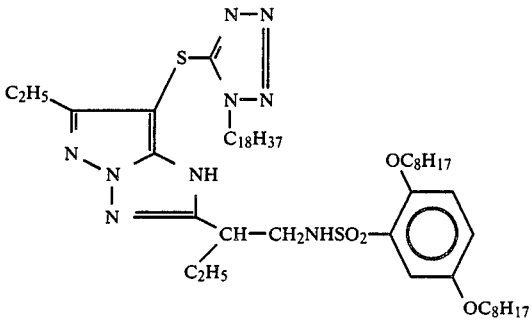
(M-45)
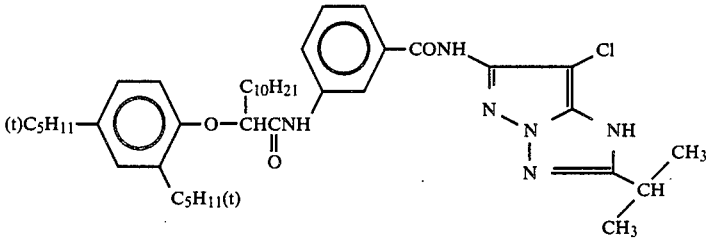
(M-46)
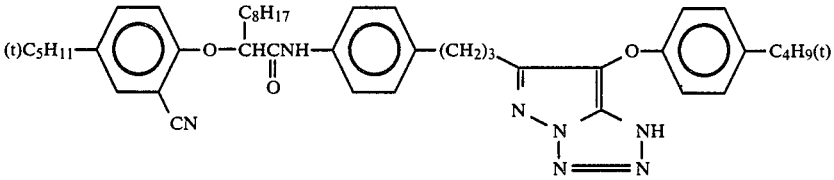
(M-47)
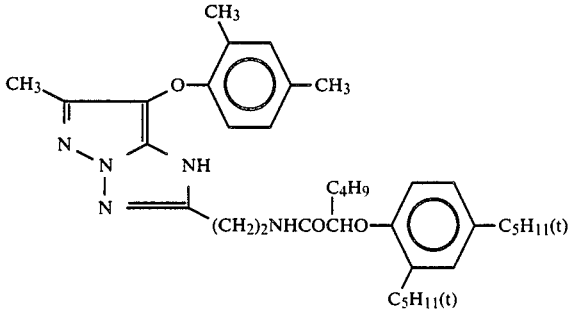

-continued
(M-48)
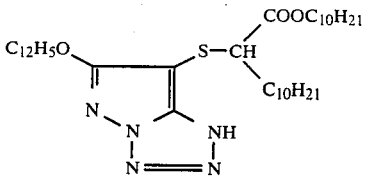
(M-49)
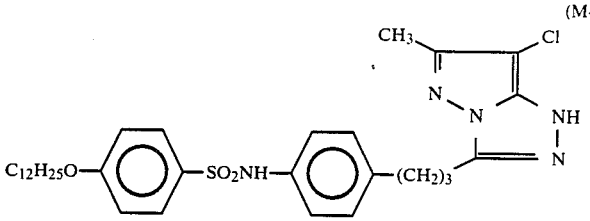
(M-50)
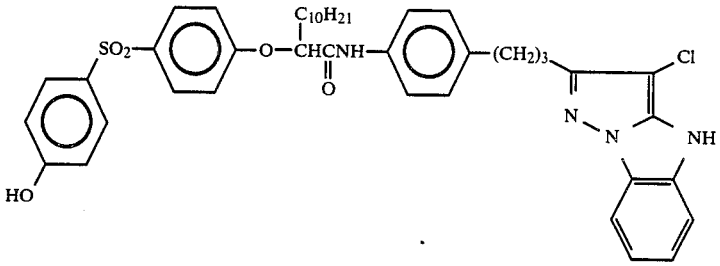
(M-51)
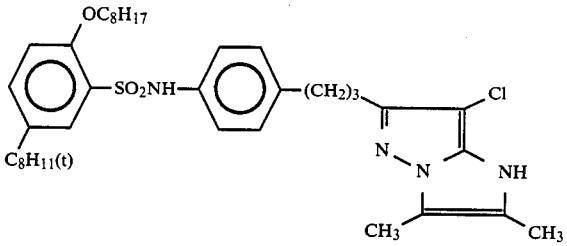
(M-52)
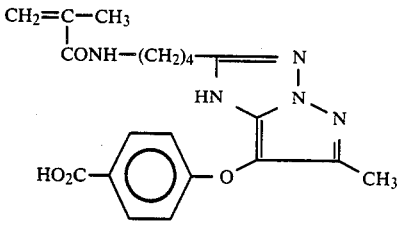
(M-53)
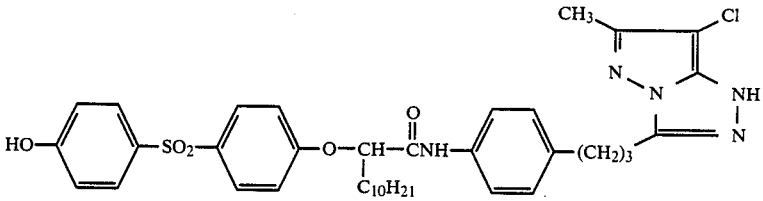
(M-54)
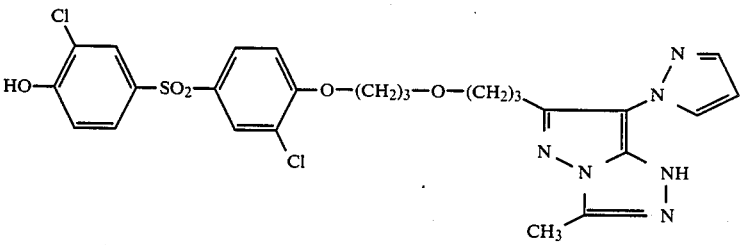
(M-55)
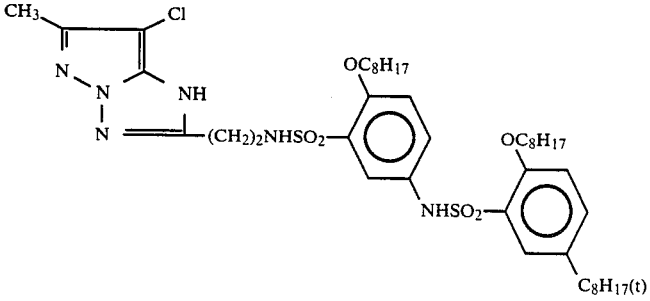

-continued

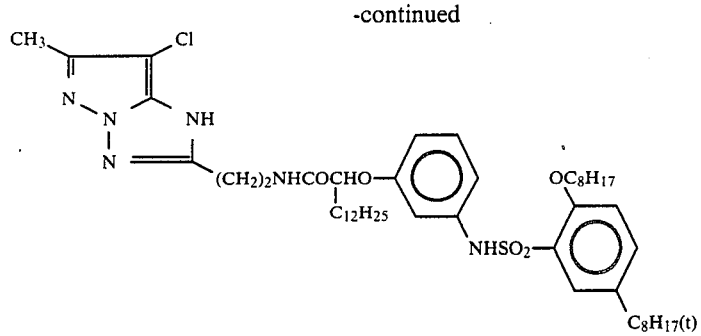

(M-56)

In the present invention, the terminology "photographic layer" means a laminate unit composed of a light-sensitive silver halide emulsion layer and a water-permeable hydrophilic colloidal layer and, in many cases, further includes an auxiliary layer, such as a protective layer. A light-insensitive backing layer that is provided on the support on the side opposite to the photographic layer does not belong to the above-referred photographic layer. It should be noted, however, the pH of the backing layer is preferably adjusted so as not to vary the pH of the photographic layer when the backing layer contacts with the photographic layer during preservation on a reel.

According to the present invention, the pH of the photographic layer after coating and drying should be lower than a pKa of the coupler used therein by at least 1.0, and preferably at least 1.7. pH adjustment of the photographic layer can be achieved by adjusting the pH value of each of coating compositions that are coated separately or simultaneously. All the coating compositions may have the same pH value, or a coating composition having a pH higher than the desired value and a coating composition having a pH lower than the desired value may be combined. Since the pH of the coating compositions and the desired pH of the photographic layer after drying are not consistent, a set value can be attained by interpolation adjustment according to results of several pretests.

The pH of the photographic layer after coating and drying (i.e., pH of a coated film) can be determined by dropping water on the coated film and contacting a flat pH electrode (e.g., "HORIBA No. 6210") therewith. In this pH measurement, the amount of water to be dropped is about 0.05 cc per $cm^2$, but a slight scatter in the water amount, e.g., about ±30%, does not cause a great change in the pH reading.

A pKa of the coupler to be used can be measured by the method of E. Gründwald described in *Journal of American Chemical Society,* Vol. 73, 4934 (1951).

The pKa values of the pyrazoloazole couplers according to the present invention can be determined in a mixed solvent of ethanol/water (80:20by volume) at 25° C. in a usual manner.

The pyrazoloazole couplers of the invention can be introduced into a light-sensitive material by various known dispersion methods typically including a solid dispersion method, an alkali dispersion method, and the like, preferably a latex dispersion method, and more preferably an oil-in-water dispersion method. According to the oil-in-water dispersion method, the coupler is dissolved in a high boiling organic solvent having a boiling point of 175° C. or higher and/or a low boiling, so-called auxiliary solvent, and the solution is then finely dispersed in an aqueous medium, such as water, an aqueous gelatin solution, etc., in the presence of a surface active agent. Examples of the high boiling organic solvents to be used are given in U.S. Pat. No. 2,322,027, etc. The dispersion may be attended with phase conversion. If desired, the auxiliary solvent used may be removed or reduced by noodle washing or ultrafiltration before coating.

Specific examples of the high boiling organic solvents which can be used for dissolving the coupler include phthalic esters (e.g., dibutyl phthalate, dicyclohexyl phthalate, di-2-ethylhexyl phthalate, decyl phthalate, etc.), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.), benzoic esters (e.g., 2-ethylhexyl benzoate, dodecyl benzoate, 2-ethylhexyl p-hydroxy benzoate, etc.), amides (e.g., diethyldodecanamide, N-tetradecylpyrrolidone, etc.), alcohols or phenols (e.g., isostearyl alcohol, 2,4-di-t-amylphenol, etc.), aliphatic carboxylic esters (e.g., dioctyl azelate, glycerol tributyrate, isostearyl lactate, trioctyl citrate, etc.), aniline derivatives (e.g., N,N-dibutyl-2-butoxy-5-t-octylaniline, etc.), hydrocarbons (e.g., paraffin, dodecylbenzene, diisopropylnaphthalene, etc.), and so on. The auxiliary solvents to be used include organic solvents having a boiling point of about 30° C. or higher, and preferably of from 50° to about 160° C. Typical examples of such auxiliary solvents are ethyl acetate, butyl acetate, ethyl propionate, methyl ethyl ketone, cyclohexanone, 2-ethoxyethyl acetate, dimethylformamide, etc.

Details of the latex dispersion method including procedures, effects and specific examples of latices for impregnation are described, e.g., in U.S. Pat. No. 4,199,363, West German Patent Application (OLS) Nos. 2,541,274 and 2,541,230, etc.

The amount of the pyrazoloazole coupler of the invention to be used usually ranges from 0.001 to 1 mol, and preferably from 0.003 to 0.3 mol, per mol of the light-sensitive silver halide. When the present invention is applied to color paper, the coverages of a yellow coupler, a magenta coupler and a cyan coupler usually range from 4 to $14\times10^{-4}$ mol/$m^2$, from 2 to $8\times10^{-4}$ mol/$m^2$ and from 2 to $9\times10^{-4}$ mol/$m^2$, respectively.

Silver halides which can be used in the present invention typically include silver chloride, silver bromide and, in addition, mixed silver halides, such as silver chlorobromide, silver chloroiodobromide, silver iodobromide, and the like. Silver halides preferably used in the present invention are silver chloroiodobromide, silver iodochloride or silver iodobromide containing not more than 3 mol% of silver iodide, silver chloride, silver bromide and silver chlorobromide. Silver halide grains may have different phases between the interior and the surface, a multiphase structure composed of fused crystals, or a homogeneous phase throughout the individual grains. Mixtures of these different types of grains may also be used.

A mean grain size of silver halide grains to be used in this invention (expressed in terms of a grain diameter when the grains are spherical or nearly spherical, or an edge length when the grains are cubic, both being averaged based on the projected area) is preferably from 0.1 to 2 μm, and more preferably from 0.15 to 1 μm. Grain size distribution may be either narrow or broad. A so-called monodispersed silver halide emulsion having narrow grain size distribution such as at least 90%, and preferably at least 95%, of the weight or number of total silver halide grains falls in the size range within ±40% of the mean grain size can be employed in the present invention. Further, in order to meet with the desired gradation, two or more monodispersed silver halide emulsions having substantially the same color sensitivity but different in grain size may be mixed and coated in the same layer or each of them may be coated in different layers. Furthermore, two or more kinds of polydispersed silver halide emulsions or a combination of a monodispersed emulsion and a polydispersed emulsion may be caoted as a mixture thereof or individually coated in different layers.

The silver halide grains which can be used in this invention may have a regular crystal form, such as a cube, an octahedron, a dodecahedron, a tetradecahedron, etc.; an irregular crystal form, such as a sphere; or a composite form thereof. Tabular grains may also be used. In particular, an emulsion wherein tabular grains having a diameter/thickness ratio of 5 or more, and particularly 8 or more, occupy 50% or more of the total projected area of grains may be employed. The emulsion to be used may be a mixture of these crystals having different forms. These various emulsions may be either of a surface latent image type, in which a latent image is predominantly formed on surfaces of grains, or of an inner latent image type, in which a latent image is predominantly formed in the interior of the grains.

The photographic emulsions to be used in the invention can be prepared by the methods described, e.g., in P. Glafkides, *Chimie et Physique Photographique,* Paul Montel (1967), G. F. Duffin, *Photographic Emulsion Chemistry,* Focal Press (1966), V. L. Zelikman et al., *Making and Coating Photographic Emulsion,* Focal Press (1964), etc. In some detail, any of the acid process, the neutral process, the ammonia process, and the like can be adopted. The reaction between soluble silver salts and soluble halogen salts can be carried out by any of a single jet method, a double jet method, a combination thereof, and the like. A so-called reverse mixing method, wherein grains are formed in the presence of an excess silver ion, can also be used. In addition, a so-called controlled double jet method, in which a pAg of a liquid phase wherein silver halide grains are formed is maintained constant, may also be employed. According to this method, a silver halide emulsion having a regular crystal form and a nearly uniform grain size can be obtained.

In the silver halide formation or physical ripening, a cadmium salt, a zinc salt, a lead salt, a thallium salt, an iridium salt or a complex salt thereof, a rhodium salt or a complex salt thereof, an iron salt or a complex salt thereof, etc., may be present.

Photographic emulsions to be used in the invention are usually subjected to physical ripening, chemical ripening and spectral sensitization. Additives which can be used in these steps are described in *Research Disclosure,* Nos. 17643 and 18716 as tabulated below. Other photographic dditives which can be used in the present invention are also shown in the following table as quoted from the same publications.

Additives and References Thereto

| Additive | RD 17643 | RD 18716 |
|---|---|---|
| Chemical sensitizer | Page 23 | Right Column on page 648 |
| Sensitivity increasing agent | Pages 23 to 24 | Right Column on page 648 |
| Spectral sensitizer and Supersensitizer | Pages 23 to 24 | Right column on page 648 to right column on page 649 |
| Brightening agent | Page 24 | |
| Antifoggant and Stabilizer | Pages 24 to 25 | Right column on page 649 |
| Light absorbent, Filter dye, and Ultraviolet absorbent | Pages 25 to 26 | Right column on page 649 to left column on page 650 |
| Stain inhibitor | Right column on page 25 | Left column to right column on page 650 |
| Dye image stabilizer | Page 25 | |
| Hardener | Page 26 | Left column on page 651 |
| Binder | Page 26 | Left column on page 651 |
| Plasticizer and Lubricant | Page 27 | Right column on page 650 |
| Coating and and Surface active agent | Pages 26 to 27 | Right column on page 650 |
| Antistatic agent | Page 27 | Right column on page 650 |

Various color couplers can be used in the present invention. Specific examples of applicable color couplers are described in patents cited in *Research Disclosure,* No. 17643, VII-C to G. Dye forming couplers which provide three primaries of subtractive color process, i.e., yellow, magenta and cyan, upon color development are important. Specific examples of anti-diffusion 4- or 2-equivalent couplers which can preferably be used in the invention include those described in patents cited in *Research Disclosure,* No. 17643, VII-C and D and, in addition, the following couplers.

Yellow couplers which can be used in the invention typically include acylacetamide couplers which have a ballast group and are thereby hydrophobic. Specific examples of the acylacetamide couplers are described, e.g., in U.S. Pat. Nos. 2,407,210, 2,875,057 and 3,265,506, etc. 2-Equivalent yellow couplers are preferred in the invention. Typical examples of such couplers include oxygen-releasable type yellow couplers as described in U.S. Pat. Nos. 3,408,194, 3,447,928, 3,933,501 and 4,022,620, etc.; and nitrogen-releasable type yellow couplers as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide couplers are excellent in color fastness particularly to light. α-Benzoylacetanilide couplers are excellent in color density.

Magenta couplers which can be used in combination with the pyrazoloazole couplers according to the invention include indazolone or cyanoacetyl couplers, and preferably 5-pyrazolone couplers, which have a ballast group and are thereby hydrophobic. Of the 5-pyrazolone couplers, those wherein the 3-position thereof is substituted with an arylamino group or an acylamino group are preferred from the standpoint of hue and density of developed colors. Typical examples of such 5-pyrazolone couplers are given, e.g., in U.S. Pat. Nos. 2,311,082, 2,343,703, 2,600,788, 2,908,573, 3,062,653, 3,152,896 and 3,936,015, etc. Coupling off groups for 2-equivalent 5-pyrazolone couplers preferably include a coupling off group containing a nitrogen atom as a coupling off atom as disclosed in U.S. Pat. No. 4,310,619 and arylthio groups as disclosed in U.S. Pat. No. 4,351,897. The 5-pyrazolone couplers having a ballast group described in European Pat. No. 73,636 provide high color densities.

Cyan couplers which can be used in the present invention include hydrophobic and anti-diffusible naphthol or phenol couplers. Typical examples thereof are the naphthol couplers described in U.S. Pat. No. 2,474,293, and preferably 2-equivalent naphthol couplers having a coupling off group containing an oxygen atom as a coupling off atom as disclosed in U.S. Pat. Nos. 4,052,212, 4,146,396, 4,228,233 and 4,296,200. Specific examples of the phenol couplers are given, e.g., in U.S. Pat. Nos. 2,369,929, 2,801,171, 2,772,162 and 2,895,826.

Cyan couplers that are fast to moisture and heat are preferably used in the invention. Typical examples of such cyan couplers include phenol cyan couplers having an ethyl group or higher alkyl group at the meta-position of their phenol nucleus as described in U.S. Pat. No. 3,772,002; 2,5-diacylamino-substituted phenol couplers as described in U.S. Pat. Nos. 2,772,162, 3,758,308, 4,126,396, 4,334,011 and 4,327,173, West German Patent Application (OLS) No. 3,329,729, European Pat. No. 121,365, etc.; phenol couplers having a phenylureido group at the 2-position and an acylamino group at the 5-position as described in U.S. Pat. Nos. 3,446,622, 4,333,999, 4,451,559 and 4,427,767, etc.; and the like.

Graininess can be improved by a combined use of couplers which form dyes having moderate diffusibility. Specific examples of such couplers are described in U.S. Pat. Nos. 4,366,237 and British Pat. No. 2,125,570 as for magenta couplers; European Pat. No. 96,570 and West German Patent Application (OLS) No. 3,234,533 as for yellow, magenta and cyan couplers.

The dye-forming couplers and the above-mentioned special couplers may be in the form of dimers or higher polymers. Typical examples of polymerized dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

Couplers capable of releasing a photographically useful residue upon coupling are also used in the invention to advantage. Useful DIR couplers capable of releasing a developing inhibitor are described in *Research Disclosure,* No. 17643, VII-F.

The photographic material of this invention is prepared by coating silver halide emulsions for forming dye image-forming layers on a flexible support usually used for photographic materials, such as a plastic film, a paper, a cloth, etc.

Examples of the useful flexible support are films composed of a semisynthetic or synthetic polymer such as cellulose acetate, cellulose acetate butyrate, polystyrene, polyethylene terephthalate, polycarbonate, etc.; and papers coated or laminated with a baryta layer or α-olefin polymer (e.g., polyethylene, polypropylene, etc.). The support may be colored by using a dye or a pigment or may be colored in black for the purpose of light shielding.

When the support is used for reflection type photographic materials, it is preferred to add a white pigment. Examples of the white pigment are titanium dioxide, barium sulfate, zinc oxide, zinc sulfide, calcium carbonate, antimony trioxide, silica white, alumina white, titanium phosphate, etc. Of these pigments, titanium dioxide, barium sulfate, zinc oxide, etc., are particularly advantageous.

A subbing treatment is generally applied to the surface of the support for improving the adhesion for photographic emulsion layers, etc. Furthermore, the surface of the support may be subjected to corona discharging, ultraviolet irradiation, flame treatment, etc., before and/or after the subbing treatment.

Also, in the case of reflective type photographic materials, a hydrophilic colloid layer containing a white pigment at a high concentration can be formed between the support and the silver halide emulsion layer for improving the whiteness and the sharpness of the photographic images.

In reflective type photographic materials containing the magenta couplers of this invention, polymer-laminated paper supports are frequently used as the support, but a synthetic resin film kneaded with a white pigment can also be used as the support. In the latter case, the photographic material is excellent in flatness, luster, and sharpness, and photographic images particularly excellent in saturation and regeneration of dark portion are obtained. In this case, as the synthetic resin film, polyethylene terephthalate, cellulose acetate, etc., are preferably used and as the white pigment, barium sulfate, titanium oxide, etc., are particularly preferred.

The color photographic light-sensitive materials in accordance with the present invention can be subjected in development by a usual process as described in *Research Disclosure,* No. 17643, pages 28–29 and *Research Disclosure,* No. 18716, page 651, left to right columns.

After the development followed by bleach-fix or fixation, the color photographic light-sensitive materials of this invention are usually subjected to washing or stabilization.

Washing is generally performed countercurrently using two or more tanks to save water. Stabilization processing conducted instead of washing is typically effected by a multistage countercurrent system as disclosed in Japanese Patent Application (OPI) No. 8543/82. In this stabilization system, 2 to 9 countercurrent baths are required. The stabilizing bath can contain various compounds to stabilize an image, for example, various buffering agents for adjusting the film to a pH of, e.g., 3 to 8 (e.g., borates, metaborates, borax, phosphates, carbonates, potassium hydroxide, sodium hydroxide, aqueous ammonia, monocarboxylic acids, dicarboxylic acids, polycarboxylic acids, etc., and combinations thereof) and formalin. If desired, other additives, such as water softeners (e.g., inorganic phosphoric acids, aminopolycarboxylic acids, organic phosphoric acids, aminopolyphosphonic acids, phosphonocarboxylic acids, etc.), bacteriocides (e.g., benzisothiazolinone, isothiazolone, 4-thiazoline-benzimidazole, halogenated phenols, etc.), surface active agents, fluorescent brightening agents, hardening agents, and the like, can also be used. Two or more of these additives may be used for the same or different purposes.

It is preferable to add various ammonium salts, e.g., ammonium chloride, ammonium nitrate, ammonium sulfate, ammonium phosphate, ammonium sulfite, ammonium thiosulfate, etc., as pH-adjusting agents after the processing.

The present invention can be applied to a wide variety of color light-sensitive materials, typically including color negative films for general use or for cinematography, color reversal films for slides or TV, color paper, color positive films, color reversal paper, and the like.

The pyrazoloazole couplers of the invention are couplers having a pyrazolobenzimidazole ring or a pyrazolotriazole ring. It was confirmed that the compounds having these residual groups have a greater mutual effect upon a silver ion or a silver halide, i.e., an activity to form a complex or an adsorbing activity, than the compounds having a 5-pyrazolone residual group which have widely been used as magenta couplers. It was further found that such a mutual effect induces sensitization or desensitization of emulsions or reduction of color density.

According to the present invention, the aforesaid mutual effect of the 5-pyrazoloazole couplers can be excluded to draw forth performance properties inherent in emulsions and the couplers by maintaining the pH of a coating film lower than a pKa of the coupler, i.e., a logarithm to a reciprocal of an acid dissociation constant of the coupler, by at least 1.0, and preferably at least 1.7. This is assumed to be because the effect of the coupler nucleus in bonding to a silver ion or in absorption onto a silver halide can be fully exerted when the coupler is in an anion state. Such a powerful mutual effect is a phenomenon noted in the pyraoloazole couplers for the first time, not being produced by the conventionally employed 5-pyrazolone couplers given in an anion state.

As described above, the silver halide photographic materials in accordance with the present invention contain at least one pyrazoloazole coupler and produce excellent effects in terms of color reproducibility and image density as well as stable photographic sensitivity.

This invention will now be illustrated in greater detail with reference to the following examples, but it should be understood that they are not intended to limit the present invention.

Unless otherwise specified, all percents, ratios, etc., are by weight.

EXAMPLE 1

On a transparent triacetyl cellulose film support were coated an emulsion layer and a protective layer having the following compositions, followed by drying to prepare Sample Nos. 1 to 11.

In 10 g of Coupler (M-21) (pKa: 8.0) were dissolved 15 g of tricresyl phosphate and 20 ml of ethyl acetate under heating at 60° C., and the resulting solution was mixed with 100 ml of an aqueous solution containing 10 g of gelatin and 1 g of sodium dodecylbenzenesulfonate. The mixture was dispersed by utilizing a high speed stirring machine to obtain a coupler dispersion.

To the whole quantity of the coupler dispersion was added 150 g of a silver chlorobromide emulsion containing 0.10 mol of a silver halide having silver chloride and silver bromide contents of 30 mol% and 70 mol%, respectively, and a grain size of 0.5 μm and 7.5 g of gelatin. The resulting coating composition was adjusted to a pH of 6.2 with 1N sulfuric acid and then coated on the above-mentioned support to a silver coverage of 0.002 mol/m$^2$. Then, a gelatin protective layer containing sodium 2-hydroxy-4,6-dichloro-s-triazinate was coated thereon. The resulting sample was designated as Sample No. 1.

Sample Nos. 2 and 3 were prepared in the same manner as described above but adjusting the coating composition to a pH of 6.8 and 5.2, respectively.

Sample Nos. 4 and 5 were prepared in the same manner as for Sample No. 1 but adjusting the coating composition to a pH of 9.2 and 7.7, respectively, with sodium hydroxide.

Sample Nos. 6 and 7 were prepared in the same manner as for Sample No. 1 except for replacing Coupler (M-21) with the same molar amount of Comparative Coupler X (pKa: 9.1) and adjusting the coating composition to a pH of 8.3 and 6.2, respectively.

Comparative Coupler X (pKa: 9.1):

1-(2,4,6-Trichlorophenyl)-3-(2-chloro-5-tetradecanamido)anilino-2-pyrazolin-5-one Furthermore, Sample Nos. 8 to 11 were prepared in the same manner as described above but adjusting a pH of the coating composition.

Each of Sample Nos. 1 to 11 was exposed to white light through a continuous optical wedge and subjected to the following processing for sensitometry. In addition, the pH of the coating film after drying (hereinafter simply referred to as "pH of a coating film") was measured in accordance with the above-described method. The results obtained are shown in Table 1.

In Table 1, Δ is the difference obtained by subtracting the pH of the coating film from the pKa of the coupler. Sensitivity ($S_{1.0}$) is a relative value of a reciprocal of an exposure necessary to provide a density corresponding to (fog+1.0). Gamma (γ) indicates a gradient of a straight line connecting the two points of density=1.0 and density=1.5.

Processing (33° C.):

| | |
|---|---|
| Color Development | 3 min 30 sec |
| Bleach-Fix | 1 min 30 sec |
| Washing | 3 min |
| Drying | 10 min |

Processing solutions used in these steps had the following compositions:

Color Developer:

| | |
|---|---|
| Benzyl Alcohol | 15 ml |
| Diethylene Glycol | 5 ml |
| Potassium Carbonate | 25 g |
| Sodium Chloride | 0.1 g |
| Sodium Bromide | 0.5 g |
| Anhydrous Sodium Sulfite | 2 g |
| Hydroxylamine Sulfate | 2 g |
| N—Ethyl-N—β-methanesulfonamidoethyl-3-methyl-4-aminoaniline Sulfate | 4 g |
| Water to make | 1 liter |
| NaOH to adjust to | pH = 10 |

Bleach-Fix Bath:

| | |
|---|---|
| Ammonium Thiosulfate | 124.5 g |
| Sodium Metabisulfite | 13.3 g |
| Anhydrous Sodium Sulfite | 2.7 g |

-continued

| | |
|---|---|
| Ammonium Ethylenediaminetetraacetate Iron (II) | 65 g |
| Water to make | 1 liter (pH = 6.8) |

TABLE 1

| Sample No. | Coupler | pH of Coating Film | Δ | Sensitivity ($S_{1.0}$) | Gamma (γ) | Remarks |
|---|---|---|---|---|---|---|
| 1 | (M-21) (pKa: 8.0) | 5.70 | 2.30 | 100 | 3.10 | Invention |
| 2 | " | 6.30 | 1.70 | 90 | 2.97 | Invention |
| 3 | " | 5.00 | 3.00 | 87 | 3.12 | Invention |
| 4 | " | 7.90 | 0.10 | 63 | 2.10 | Comparison |
| 5 | " | 7.15 | 0.85 | 73 | 2.38 | Comparison |
| 6 | X (pKa: 9.1) | 8.10 | 1.00 | 98 | 2.80 | Reference |
| 7 | " | 5.80 | 3.30 | 76 | 2.80 | Reference |
| 8 | " | 9.15 | −0.05 | 100 | 2.78 | Reference |
| 9 | " | 7.40 | 1.70 | 93 | 2.81 | Reference |
| 10 | " | 6.85 | 2.25 | 89 | 2.82 | Reference |
| 11 | " | 5.10 | 4.00 | 54 | 2.73 | Reference |

The highest sensitivity among samples using the same coupler was taken as standard (100).

It can be seen from the results of Table 1 that reduction in sensitivity and gamma of samples using Coupler (M-21) can be controlled within a substantially acceptable range by adjusting the pH of the coating film at 6.3 or smaller when the pKa of the coupler is 8.0.

Samples using (M-24), (M-39), (M-47) or (M-54) in place of (M-21) were prepared and tested in the same manner as described above. As a result, it was confirmed that light-sensitive materials which undergo much less variation in sensitivity and gamma can be obtained by adjusting the pH of the coating film lower than a pKa of the pyrazoloazole coupler by about 1.7 or more.

REFERENCE EXAMPLE

Sample Nos. 12 and 13 were prepared in the same manner as for Sample Nos. 4 and 1 of Example 1, respectively, except that Coupler (M-21) was not added. The coating compositions for Sample Nos. 12 and 13 were adjusted to the same pH values as Sample Nos. 4 and 1, respectively.

Each of Sample Nos. 12 and 13 and Sample Nos. 4, 1, 6 and 7 as prepared in Example 1 was exposed to white light through a continuous optical wedge and developed with an aminophenol-ascorbic acid developer having the following formulation at 20° C. for 10 minutes. The pH of the coating film was determined in the same manner as in Example 1, and the results obtained are shown in Table 2 together with the results of sensitometry.

Aminophenol-Ascorbic Acid Developer:

| | |
|---|---|
| Ascorbic Acid | 10 g |
| p-Methylaminophenol | 2.4 g |
| Sodium Carbonate | 10 g |
| Potassium Bromide | 1 g |
| Water to make | 1 liter |

TABLE 2

| Sample No. | pH of Coating Film | Sensitivity | Gamma | Remarks |
|---|---|---|---|---|
| 4 | 7.9 | 61 | 0.81 | Comparison |
| 1 | 5.7 | 82 | 0.85 | Invention |
| 6 | 8.1 | 100 | 0.85 | Comparison |
| 7 | 5.8 | 80 | 0.85 | Comparison |
| 12 | 7.9 | 100 | 0.85 | Reference |
| 13 | 5.8 | 79 | 0.85 | Reference |

In Table 2, the sensitivity was obtained by measuring a silver image density by the use of a densitometer and relatively expressed taking that of Sample No. 6 as a standard (100).

Comparisons between Sample Nos. 6 and 7 and between Sample Nos. 12 and 13 reveal that the difference in sensitivity between Sample Nos. 6 and 7 due to a difference in pH of the coating film is attributed to pH dependence of silver halide grains per se and that the coupler used does not substantially participate in the sensitivity difference. It can further be seen from comparisons between Sample Nos. 4 and 1 and between Sample Nos. 12 and 13 that Sample No. 1 undergoes substantially no influence of the coupler, whereas Sample No. 4 decreases in sensitivity and contrast through the influence of the coupler.

These results thus provde the effectiveness of lowering the pH of the coating film in using pyrazoloazole couplers.

EXAMPLE 2

Sample Nos. 1′ and 4′ were prepared in the same manner as for Sample Nos. 1 and 4, respectively, except that the pH of the coating composition for the emulsion layer was not adjusted and the pH of the coating composition for the protective layer was lowered with sulfuric acid or raised with sodium hydroxide. Each sample was exposed to light and processed in the same manner as described in Example 1. The results obtained are shown in Table 3 below.

TABLE 3

| Sample No. | pH of Coating Film | Sensitivity | Gamma |
|---|---|---|---|
| 1′ | 5.6 | 99 | 2.9 |
| 4′ | 7.8 | 54 | 2.1 |

When compared with the results of Sample Nos. 1 and 4 of Example 1, the results of Table 3 show that sensitivity and gamma greatly depend on the pH of the coating film.

EXAMPLE 3

Sample Nos. 14 to 27 were prepared in the same manner as for samples of Example 1 but replacing Coupler (M-21) with the coupler shown in Table 4 and adjusting the pH of the coating composition so that the coating film had a pH shown in Table 4. Each of the samples was exposed to light and processed for sensitometry in the same manner as in Example 1. The results obtained are shown in Table 4.

TABLE 4

| Sample No. | Coupler | pH of Coating Film | Δ | Sensitivity | Gamma |
|---|---|---|---|---|---|
| 14 | Y (pKa: 6.3) | 6.8 | −0.5 | 100 | 3.1 |
| 15 | " | 5.6 | 0.8 | 92 | 3.2 |
| 16 | " | 4.6 | 1.7 | 81 | 3.1 |
| 17 | (M-28) (pKa: 8.4) | 7.7 | 0.7 | 80 | 2.0 |
| 18 | " | 7.0 | 1.4 | 104 | 2.3 |
| 19 | " | 6.5 | 1.9 | 100 | 3.0 |
| 20 | Z (pKa: 8.1) | 7.2 | 0.9 | 100 | 2.7 |
| 21 | " | 6.2 | 1.9 | 90 | 2.7 |
| 22 | (M-56) (pKa: 8.2) | 7.0 | 1.2 | 89 | 2.0 |
| 23 | " | 6.4 | 1.8 | 100 | 2.6 |
| 24 | (M-33) (pKa: 9.0) | 7.8 | 1.2 | 93 | 2.4 |
| 25 | " | 6.8 | 2.2 | 100 | 3.2 |
| 26 | (M-55) (pKa: 8.1) | 7.2 | 0.9 | 89 | 2.3 |
| 27 | " | 6.0 | 2.1 | 100 | 3.0 |

Coupler Y: 1-(2,4,6-Trichlorophenyl)-3-(2-chloro-5-tetradecanamido)anilino-4-(2-butoxy-5-t-octylphenylthio)-2-pyrazolin-5-one Coupler Z: 1-(2,4,6-Trichlorophenyl)-3-{3-[α-(2,4-di-t-pentylphenoxy)butanamido]benzamido}-2-pyrazolin-5-one In Table 4, the highest sensitivity among samples containing the same coupler was taken as a standard (100).

Examination of Sample Nos. 14 to 16, 20 and 21 wherein Comparative Coupler Y or Z, which is a 5-pyrazolone coupler, was used shows that lowering of the pH of the coating film only results in decreased sensitivity attributed to reduction in sensitivity of the silver halide itself without substantially accompanying a change in gamma. To the contrary, it can be seen from the results of samples wherein pyrazolotriazole couplers, i.e., (M-28), (M-33), (M-55) and (M-56), were used that lowering of the pH of the coating film rather increases sensitivity and makes gamma approach the level inherent to the emulsion. That is, development inhibition and reduction in color density can be prevented by lowering the pH of the coating film.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer, wherein said emulsion layer or a layer adjacent thereto contains at least one pyrazoloazole coupler and substantially all photographic layers including the light-sensitive silver halide layer and the layer adjacent thereto each having been coated on the same surface of the support and then dried have a pH lower than the pKa of said coupler by 1.0 or more.

2. A silver halide photographic material as in claim 1, wherein substantially all photographic layers including the light-sensitive silver halide layer and the layer adjacent thereto each having been coated on the same surface of the support and then dried have a pH lower than the pKa of said coupler by 1.7 or more.

3. A silver halide photographic material as in claim 1, wherein said pyrazoloazole coupler is represented by the formula (I):

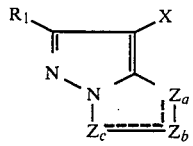

(I)

wherein $R_1$ represents a hydrogen atom or a substituent; X represents a hydrogen atom or a group releasable upon coupling with an oxidation product of an aromatic primary amine developing agent; $Z_a$, $Z_b$ and $Z_c$ each represents a methine group, a substituted methine group, =N— or —NH—; either one of the $Z_a$–$Z_b$ bond and the $Z_b$–$Z_c$ bond is a double bond with the other being a single bond; when the $Z_b$–$Z_c$ bond is a carbon-carbon double bond, it may form an aromatic ring; when any one of $R_1$, X and the substituted methine group as represented by $Z_a$, $Z_b$ or $Z_c$ is a divalent or polyvalent group, it may form a dimer or polymer.

4. A silver halide photographic material as in claim 3, wherein said pyrazoloazole coupler is represented by the formulae (II), (III), (IV), (V), (VI) or (VII):

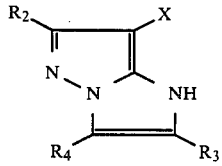

(I-1)

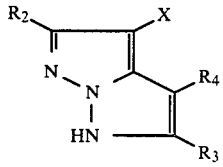

(I-2)

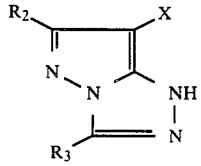

(I-3)

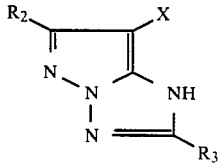

(I-4)

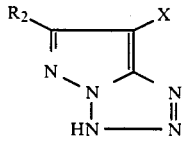

(I-5)

-continued

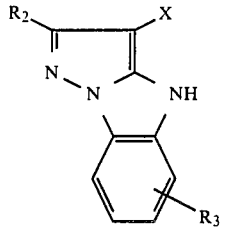

(I-6)

wherein X is as defined in claim 3; $R_2$, $R_3$ and $R_4$ each represents a hydrogen atom, a substituted or unsubstituted alkyl group, a substituted or unsubstituted aryl group, a substituted or unsubstituted heterocyclic group, a cyano group, a substituted or unsubstituted alkoxy group, a substituted or unsubstituted aryloxy group, a substituted or unsubstituted heterocyclic oxy group, a substituted or unsubstituted acyloxy group, a substituted or unsubstituted carbamoyloxy group, a substituted or unsubstituted silyloxy group, a substituted or unsubstituted sulfonyloxy group, a substituted or unsubstituted acylamino group, a substituted or unsubstituted anilino group, a substituted or unsubstituted ureido group, a substituted or unsubstituted imido group, a substituted or unsubstituted sulfamoylamino group, a substituted or unsubstituted carbamoylamino group, a substituted or unsubstituted alkylthio group, a substituted or unsubstituted arylthio group, a substituted or unsubstituted heterocyclic thio group, a substituted or unsubstituted alkoxycarbonylamino group, a substituted or unsubstituted aryloxycarbonylamino group, a substituted or unsubstituted sulfonamido group, a substituted or unsubstituted carbamoyl group, a substituted or unsubstituted acyl group, a substituted or unsubstituted sulfamoyl group, a substituted or unsubstituted sulfonyl group, a substituted or unsubstituted sulfinyl group, a substituted or unsubstituted alkoxycarbonyl group, a substituted or unsubstituted aryloxycarbonyl group, a substituted or unsubstituted alkenyl group, a substituted or unsubstituted carboxyl group, a substituted or unsubstituted sulfo group, a hydroxyl group, a substituted or unsubstituted amino group, or a substituted or unsubstituted carbonamido group; when the formula (I-6) contains two or more $R_3$ substituents, they may be the same or different, and any one of $R_2$, $R_3$, $R_4$ and X may be a divalent or polyvalent group which forms a dimer or a polymer or which can be bonded to a higher molecular weight main chain to form a high molecular weight coupler.

5. A silver halide photographic material as in claim 4, wherein any substituent is selected from the group consisting of a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, a hydroxyl group, an amino group and a carbonamido group.

6. A silver halide photographic material as in claim 4, wherein the coupler does not contain —COOH or —$SO_3H$.

7. A silver halide photographic material as in claim 1, wherein the coupler is introduced into the light-sensitive material by a latex dispersion method or an oil-in-water dispersion method.

8. A silver halide photographic material as in claim 1, wherein said photographic layers comprise a laminate unit of at least said one light-sensitive silver halide emulsion layer and at least a water-permeable hydrophilic colloidal layer.

9. A silver halide photographic material as in claim 8, which further comprises an auxiliary layer.

* * * * *